US006045413A

United States Patent [19]

Creux

[11] Patent Number: 6,045,413

[45] Date of Patent: Apr. 4, 2000

[54] CONNECTOR WITH INTEGRAL SECONDARY LOCK

[75] Inventor: Francis Creux, Eybens, France

[73] Assignee: Proner Comatel, Noisy-le-Grand, France

[21] Appl. No.: 09/055,223

[22] Filed: Apr. 6, 1998

[30] Foreign Application Priority Data

Apr. 4, 1997 [FR] France ..... 97 04165

[51] Int. Cl.[7] ..... H01R 13/514

[52] U.S. Cl. ..... 439/752; 439/595; 439/596

[58] Field of Search ..... 439/752, 595, 439/596

[56] References Cited

U.S. PATENT DOCUMENTS 5,716,235 2/1998 Endo et al. ..... 439/752

FOREIGN PATENT DOCUMENTS

| | | | |
|---|---|---|---|
| 0 691 710 | 1/1996 | European Pat. Off. | H01R 13/436 |
| 0 762 550 | 3/1997 | European Pat. Off. | H01R 13/422 |
| 2 294 818 | of 0000 | United Kingdom | H01R 13/436 |
| WO 96/34429 | 10/1996 | WIPO | H01R 13/436 |

*Primary Examiner*—Paula Bradley
*Assistant Examiner*—Alexander Gilman
*Attorney, Agent, or Firm*—Young & Thompson

[57] ABSTRACT

The connector is constituted by two parts adapted to be coupled to ensure an electrical connection, comprising at least one insulating housing adapted to receive electrical contacts carried by cables and maintained in the housing by means of primary locking.

It comprises a secondary lock serving as a portion integrating said housing and adapted, when not in locking position, to prevent the coupling of the connector.

9 Claims, 3 Drawing Sheets

CONNECTOR WITH INTEGRAL SECONDARY LOCK

BACKGROUND OF THE INVENTION

The invention relates to a connector with an integral secondary lock, for example an electrical connector with clips and tongues, in which the secondary lock is secured to the clip carrier or the tongue carrier.

In the use of electrical connectors particularly in industry and automotives, the technique of soft plugging in, which is to say with low force of plugging in or very low force, is more and more used.

The plugging-in force being very low, it is essential that the clips and tongues to be coupled be positioned with exactitude and that their correct position can be controlled before the connection operation.

Connectors use primary locks to lock in position the clips in their housing of plastic material. These primary locks are for example fingers which move aside during introduction of the clip into the housing and which come to constitute a rear abutment, when the clip is in correct position, to maintain it in this correct position. These primary locks are in general disposed within the housing and they are not visible from outside. If in the course of the operation of inserting the clip in the housing, the clip is not brought to its correct position, the primary lock remains in deflected position and does not play its role, but this cannot be detected from outside. Upon an ultimate coupling operation of the connector, the clip can recoil under the pressure of the tongue and the contact cannot be made unless an operator does it deliberately.

To avoid this drawback, there is provided a secondary lock, which is to say a supplemental member, visible from outside or adapted to prevent the mechanical coupling of a connector. Such a secondary lock is in general an external member, which must be emplaced on the housing, and which takes the correct position only if the electrical members of the connector are in the correct position. Ordinarily, these secondary locks are of the slide or drawer type, and they are emplaced on the housing in the course of an assembly operation.

SUMMARY OF THE INVENTION

One of the objects of the invention is to provide a secondary lock which does not require a supplemental member and assembly operation to avoid the difficulties of this assembly operation and to reduce the cost of production of the connectors.

Another object of the invention is to provide a secondary lock whose swinging into locking position is indispensable to permit mechanical coupling of the connector.

Still another object of the invention is to provide a secondary lock which, once in correct locking position, automatically locks in this position, and cannot be unlocked except with a tool.

The invention has for its object a connector with an integral secondary lock, constituted by two members adapted to be coupled to ensure an electrical connection, comprising at least one insulating housing adapted to receive the electrical contacts carried by the cables and maintained in the housing by a primary locking means, characterized in that it comprises a second lock which is an integral part of the housing and is adapted, when it is not in a locked position, to prevent coupling of the connector.

According to other characteristics of the invention:

the secondary lock comprises at least one deformable wall, at least one rigid wing articulated on the deformable wall, at least one longitudinal rod articulated on the rigid wing and at least one cog carried by the bar;

the secondary lock has two stable positions, a ready position and a locked position, the passage from the ready position to the locked position taking place with a downward movement;

the secondary lock is constituted by two deformable side walls carried by the housing, two rigid wings each articulated on one of said lateral deformable walls, a longitudinal bar disposed between the two wings and articulated on each between them, and at least one lug carried by the bar and adapted, in a locked position, to be inserted behind the electrical contacts;

the lug is connected to the housing by connectors adapted to be broken by pressure on the bar during passage into the locked position;

the lug carries an elastically deformable stop, and has a hook adapted to snap below a shoulder of the housing to ensure a safety locking operation when the secondary lock is in the locking position;

the lug carries a guide heel coacting with a groove in the connector to ensure guiding of the lug during its passage toward the secondary locking position;

the passage from the position preventing coupling of the connector to the locking position takes place by pressure on the bar and flexural deformation of the side walls;

the lug has a profile adapted to coact shape-matingly with a shape of the housing to ensure a safety locking function when the secondary lock is in the locked position;

the lug is inserted in the locking position at the level of the region of transition of the electrical contacts;

the secondary lock is carried by any surface of the housing.

BRIEF DESCRIPTION OF THE DRAWINGS

Other characteristics will become apparent from the description which follows, given with reference to the accompanying drawings, in which.

DESCRIPTION OF THE PREFERRED EMBODIMENTS

Figure 1:
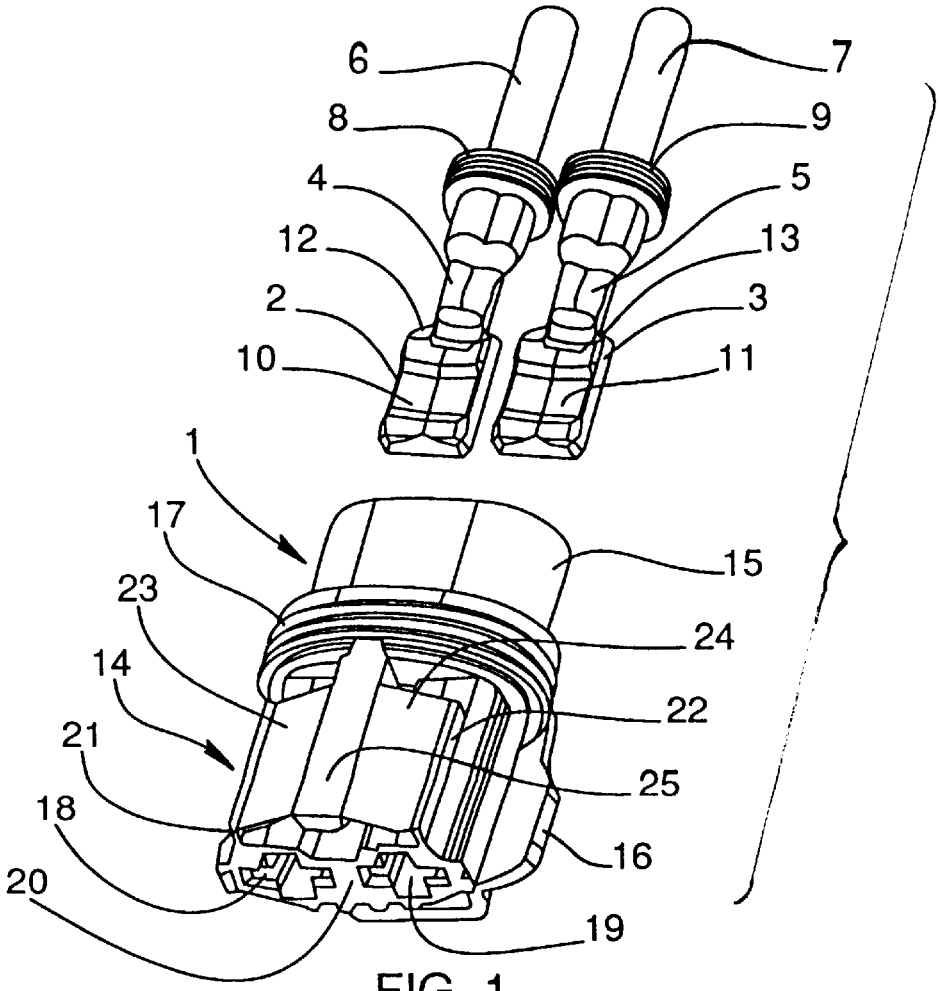
FIG. 1 is a perspective view of an embodiment of a clip carrier for a connector according to the invention, provided with a secondary lock before emplacement of the clips.

In FIG. 1, the clips carrier 1 of a connector according to the invention is shown with two clips 2, 3 ready to be inserted from the rear, each of the two clips 2, 3 is seated on a cable, respectively 4 and 5.

The sleeves 6, 7 of the cables carry seated sealing joints 8, 9 respectively.

The clips 2, 3 each comprise a cage 10, 11 of generally parallelepipedal shape.

Between this cage 10, 11 and the seating 4, 5 on the respective cable, the clips 2, 3 have a transition region 12, 13 respectively.

The clips carrier 1 is essentially constituted by a housing of plastic material, having a front portion 14 adapted to receive the clips 2, 3 and a rear portion 15 adapted to coact with the seated joints 8, 9 for ensuring sealing of the clips carrier.

The rear portion 15 carries a half-shell 16 extending forwardly and adapted to ensure mechanical connection with a tongue carrier or a base, for example. In its central portion, the clips carrier 1 carries an interfacial sealing joint 17.

The front surface of the front portion 14 of the clips carrier 1 has two openings 18, 19 of generally cruciform shape, adapted to let pass the electrical contact tongues of the tongues carrier constituting the other element of the connector, or of the base, for example. When they are correctly mounted, the clips 2, 3 are located in abutment against the front surface of the clips carrier, just behind the cruciform openings 18, 19.

The recesses adapted to receive the clips 2, 3 behind the openings 18, 19, are separated by an intermediate partition 20.

Above the recesses adapted to receive the clips 2, 3, the clips carrier carries a secondary lock.

The secondary lock is symmetrical relative to the longitudinal plane of symmetry of the clips carrier, and is constituted by two deformable side walls 21, 22, substantially vertical in rest position, two rigid wings in the form of a roof with two symmetrical slopes 23, 24, and a bar 25, substantially axial, each of the two wings 23, 24 being articulated on the one hand on a deformable side wall 21, 22 respectively, and on the other hand on the bar 25.

Figure 2:
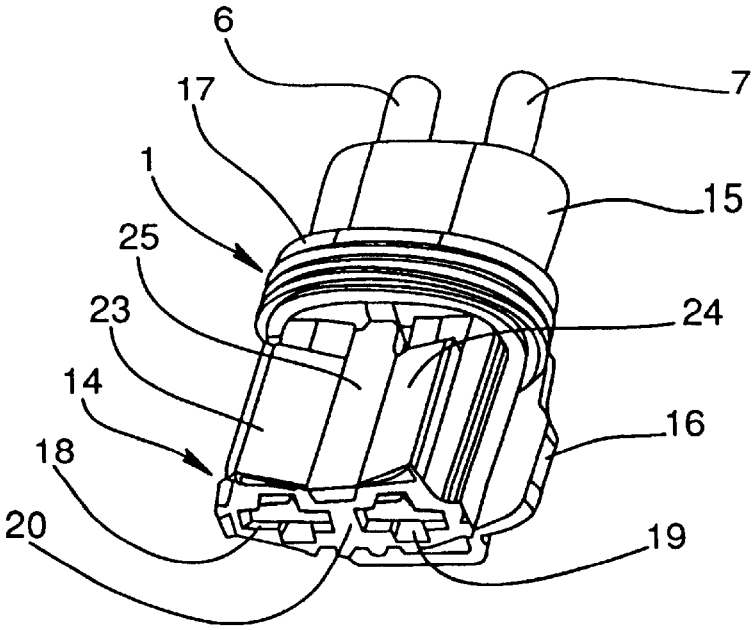
FIG. 2 is a view similar to FIG. 1, after emplacement of the clips, and after correct locking positioning of the secondary lock.

The bar 25 has two stable positions, one upper ready position, shown in FIG. 1, the other a lower locking position, shown in FIG. 2. In the upper or ready position, the bar 25 is disposed in front of the edge of the clips carrier 1, in line with the interfacial joint 17, such that, by its front surface which is in line with the front surface of the front portion 14 of the clips carrier 1, it constitutes an obstacle preventing coupling of the connector. In its lower or locking position, the bar 25 is applied against the intermediate partition 20; it is entirely disposed within the internal volume of the clips carrier 1 and permits coupling of the connector.

The passage from the upper position to the lower position takes place by bending outwardly the lateral deformable walls 21, 22 under the action of a pressure exerted on the bar 25 and transmitted by the rigid wings 23, 24. In the course of the descending movement of the bar 25, the inclination of the wings 23, 24 to the horizontal plane has the tendency to decrease until it disappears at the time when the lateral walls are deformed maximally outwardly, then this inclination reverses and increases to the lowermost position of the bar 25.

The passage from the stable ready position to the stable locking position takes place with an over-center effect, or a snap action, by reason of the elasticity of the side walls 21, 22.

Figure 3:
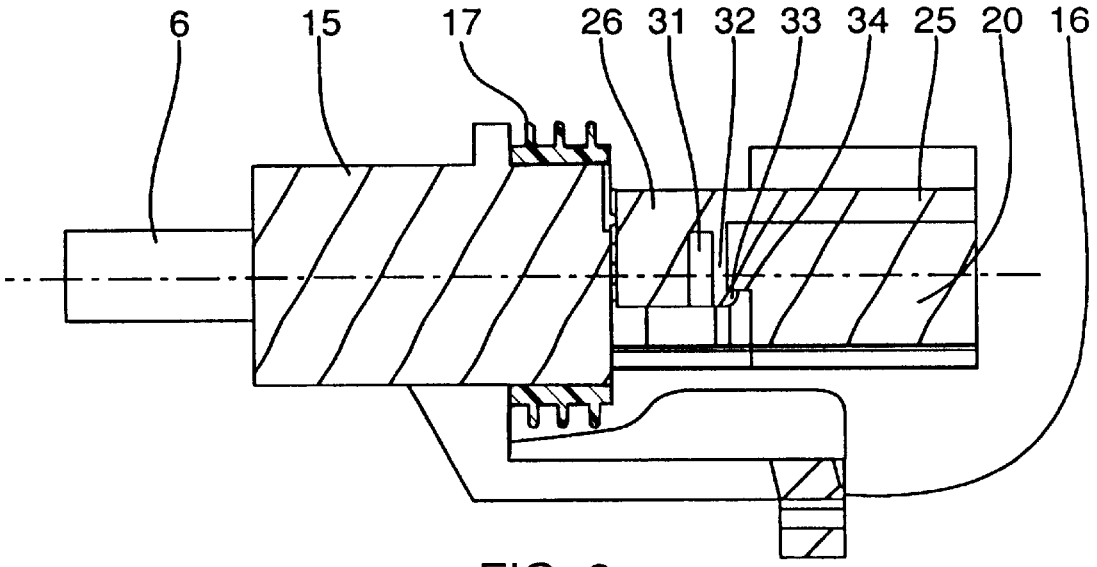
FIG. 3 is a cross-sectional view on the longitudinal symmetry plane of the clips carrier of FIG. 2, in the case of correct secondary locking.

In FIG. 3, the bar 25 is visible bearing against the intermediate partition 20. At its rear portion, in line with the interfacial joint 17, the bar 25 has a lug 26 adapted to be inserted behind the transition zones 12, 13 of the clips 2, 3.

Figure 5:
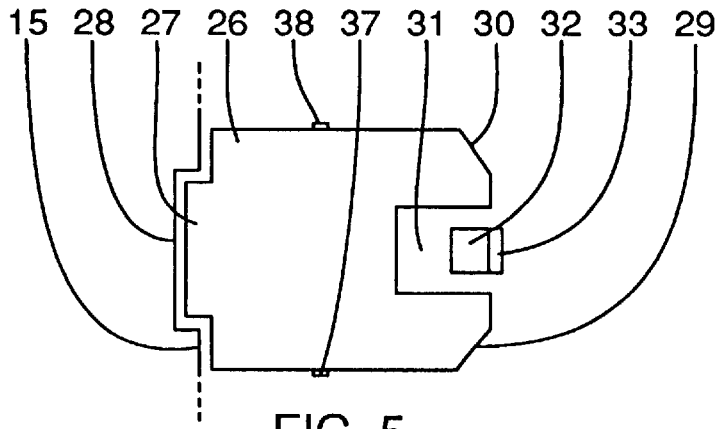
FIG. 5 is a fragmentary horizontal cross-sectional view showing the arrangement of the lug of the secondary lock relative to the clips and to the housing of the clips carrier.

FIG. 5 shows the retention of this lug 26 which has a rear heel 27 sliding in a vertical groove 28 of the rear portion 15 of the clips carrier 1. The groove 28 assures guidance of the lug 26 in the course of its vertical movement imposed by the bar 25. The bottom of the groove plays the role of a rear abutment for the lug 26 and the bar 25 so as to avoid loss of the locking function in the case of a force directed rearwardly to which the bar 25 may be subjected before the secondary lock is closed.

The lug 26 has at its front two lateral chamfers 29, 30 adapted to slide behind the transition zones 12, 13 of the clips 2, 3, on the one hand to permit descent of the lug 26 to show the correct position of the clips in the housing, on the other hand to aid in reinforcing the operation of maintaining the primary locks on the clips.

The lug 26 has forwardly a recess 31 which surrounds a locking stop 32. This stop 32 is provided at its lower end with a hook 33 adapted to hook below a shoulder 34 of the intermediate partition 20 thereby effecting the safety locking function of the assembly 23-24-25-26 in the secondary locking lower position.

In the course of descending movement of the bar 25 and of the lug 26, the stop 32 moves aside rearwardly because its lower end is chamfered from the side of the hook 33. When the lug 26 arrives in the correct lower position, the hook 33 clicks below the shoulder 34.

Figure 4:
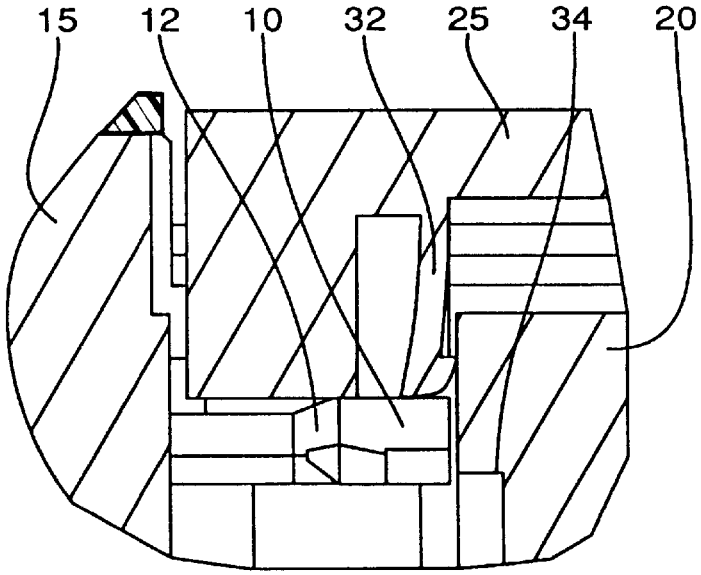
FIG. 4 is a fragmentary view analogous to FIG. 3 in the case of incorrect secondary locking.

FIG. 4 shows that if a clip is not in the correct position in the housing, which is to say if it is not in an advance position against the front wall of the clips carrier, the transmission zone, 12 for example, and as the case may be the cage 10 of the clip prevent the descent of the lug 26 and the carrying out of the secondary locking function. In this case, on the one hand the bar 25 cannot descend to the end of its course and it prevents coupling of the connector, on the other hand the hook 33 of the stop 32 cannot snap below the shoulder 34 and the safety locking function cannot be ensured.

Figure 6:
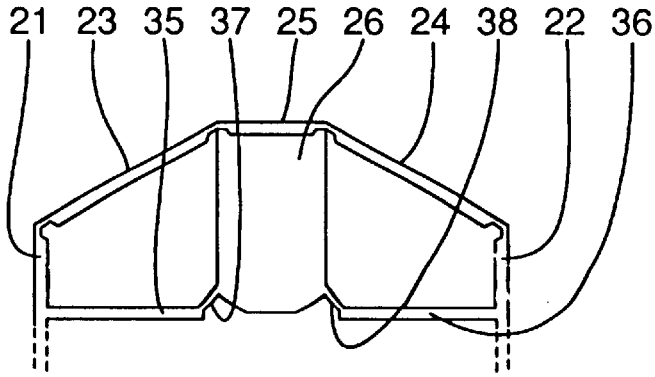
FIG. 6 is a vertical cross-sectional view of FIG. 5, showing the retaining connections of the lug of the secondary lock.

FIG. 6 shows a simplified view in which the lug 26 secured to the bar 25 is, during molding by injection of the clips carrier housing, secured to the lateral partitions 35, 36, by means of very thin connectors 37, 38. These connectors serve first to facilitate the injection of the lug, then to ensure the centering of the lug before manipulation of the secondary lock, and finally to take part in the insertion effort of the lug so as to avoid accidental insertion before mounting of the clips carrier.

The secondary lock according to the invention include a deformable portion of the casing of plastic material constituting the front portion of the clips carrier 1. It comprises essentially: the two deformable side walls 21, 22 which is secured to the housing by their base and whose upper longitudinal edge constitutes a hinge for the rigid wings 23, 24; the two rigid wings 23, 24, articulated on the one hand on the deformable side walls 21, 22 and on the other hand on the bar 25, the longitudinal bar 25; the lug 26 with its connectors 37, 38 and its guide heel 27; and the elastically deformable stop 32 carrying the hook 33 to snap below the shoulder 34 of the intermediate partition 20.

The secondary lock can be mounted with the bar 25 in the upper position, which prevents coupling of the connector. After correct insertion of the clips into the clips carrier, a pressure on the bar 25 first to breaks the connectors 37, 38 and frees the lug 26. This is followed by the descent of the bar 25 and of the lug 26 with elastic flexure of the side walls 21, 22, and elastic flexure of the stop 32 rearwardly by bearing on its hook 33 on the intermediate partition 20; then, after passage to the neutral point, the continued descent of the assembly of the bar 25 and the lug 26, to the correct low position which corresponds to insertion of the lug 26 at the level of the transition zone 12, 13 of the electrical contacts 2, 3 and to the snapping in of the hook 33 below the shoulder 34 of the intermediate partition 20.

The secondary lock according to the invention has been described in a symmetrical structure, but it can be constituted solely of one deformable lateral wall, one rigid wing and one bar carrying the lug, the bar or the lug being simply guided on one side by a rigid wall of the housing.

Figure 7:
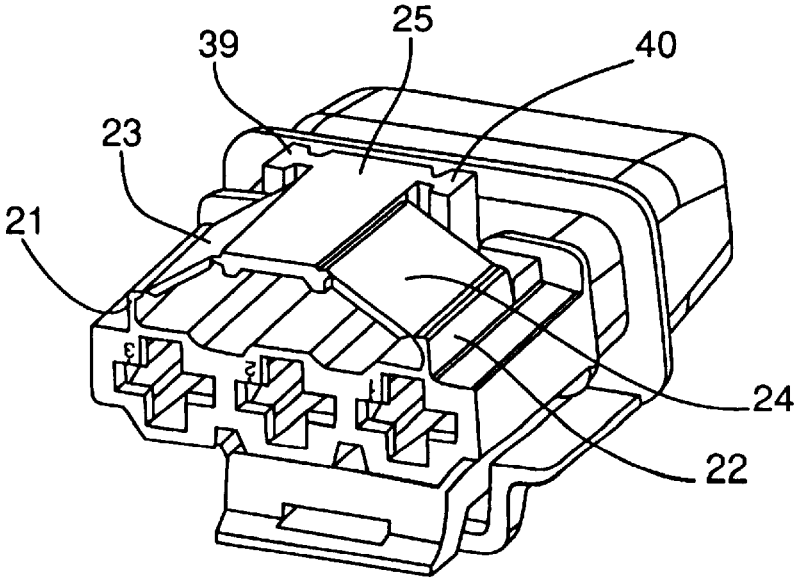
FIG. 7 is a perspective view of another embodiment of a clips carrying housing of a connector according to the invention, provided with a secondary lock, in the case of a connector with three clips.

The secondary lock according to the invention is applicable as well to the case of two clips (FIGS. 1–6) as to the case of several clips. In the case of three clips (FIG. 7), the bar 25 carries two lugs 39, 40 each of which comes to be inserted between two clips, and it suffices that one lug bear a hooking stop.

The bar 25 can also be replaced by a plate or by an assembly of two bars, each forming a lug, and interconnected by a plaque.

The secondary lock has been described with a lug 26 carrying a stop 32 coacting with a shoulder 34 of the intermediate partition 20 to ensure safety locking. This safety locking can be ensured by other means, and particularly by wedging, or by cooperation by agreement as to shape of the two profiles, one carried by the lug 26, the other by the housing, for example.

The unlocking of the secondary lock can be carried out by means of a tool such as a screwdriver, which ensures the unlocking of the stop 32 and the rising of the lug 26 and of the bar 25, which returns the assembly to the original position.

The invention has been described with reference to the example of a clips carrier adapted to be coupled to a tongues carrier. It is also applicable to the case of a clips carrier adapted to be coupled to a base, for example.

The invention has been described in the case of contacts with clips, but it is also applicable to contacts with tongues, to male or female contacts of any shape and any cross section.

The secondary lock according to the invention has been described in an arrangement on a lateral surface of a housing of the connector, but it could also be disposed on any one of the surfaces of the housing, as a function of the arrangement, geometry of the contacts themselves, in a line or in a triangle for example, and their relative orientation.

The connector according to the invention is particularly applicable to automobile connections with power contacts.

I claim:

1. Connector with integrated secondary lock, constituted by two portions adapted to be coupled to ensure an electrical connection, comprising at least one insulating housing adapted to receive electrical contacts carried by cables and maintained in the housing by primary locking means, the secondary lock serving as an integral portion of said housing, the secondary lock being adaptable, when it is not in locking position, to prevent coupling of the connector and comprising at least one deformable wall, at least one rigid wing articulated on the deformable wall, at least one longitudinal bar articulated on said rigid wing and at least one lug carried by the bar.

2. The connector according to claim 1, wherein the secondary lock has two stable positions, a ready position and a locking position, a passage from the ready position to the locking position taking place with a snap action.

3. The connector according to claim 1, wherein the secondary lock comprises two of said deformable side walls carried by the housing, two of said rigid wings each articulated on one of said two deformable side walls, said longitudinal bar being disposed between the two wings and articulated on each between them, and wherein said one lug is adapted, in a locked position, to be inserted behind electrical contacts.

4. The connector according to claim 3, wherein the lug is connected to the housing by connectors adapted to be broken by pressure on the bar during passage into the locking position.

5. The connector according to claim 3, wherein the lug carries a resiliently deformable stop and a hook adapted to snap below a shoulder of the housing to ensure a safety locking function when the secondary lock is in the locked position.

6. The connector according to claim 3, wherein the lug carries a guide heel coacting with a groove in the connector so as to ensure the guidance of the lug during its passage toward the locked position.

7. The connector according to claim 3, wherein the passage from a position preventing coupling of the connector to the locked position takes place by pressure on the bar and deformation by flexing of the side walls.

8. The connector according to claim 3, wherein the lug has a profile adapted to coact shape-matingly with a profile of the housing to ensure a locking safety function when the secondary lock is in the locked position.

9. The connector according to claim 3, wherein the lug inserts itself in the locking position at the level of a transition zone of the electrical contacts.

* * * * *